US005766076A

United States Patent [19]

Pease et al.

[11] Patent Number: 5,766,076

[45] Date of Patent: Jun. 16, 1998

[54] PROGRESSIVE GAMING SYSTEM AND METHOD FOR WIDE APPLICABILITY

[75] Inventors: Logan L. Pease, Reno; Dwight E. Crevelt, Las Vegas, both of Nev.

[73] Assignee: International Game Technology, Reno, Nev.

[21] Appl. No.: 600,670

[22] Filed: Feb. 13, 1996

[51] Int. Cl.[6] ..... A63F 9/22

[52] U.S. Cl. ..... 463/27

[58] Field of Search ..... 463/27, 26, 25, 463/20, 42, 41, 40; 273/143 R; 364/412, 410

[56] References Cited

U.S. PATENT DOCUMENTS 5,116,055 5/1992 Tracey ..... 463/27

5,564,700 10/1996 Celona ..... 463/27

*Primary Examiner*—Jessica Harrison

*Assistant Examiner*—Michael O'Neill

*Attorney, Agent, or Firm*—Sheridan Ross P.C.

[57] ABSTRACT

A progressive gaming system with wide applicability to a potentially large number of players is provided. A three-level hierarchy can be used in which a portion of wagers and individual terminals are earmarked for contribution to a progressive jackpot, each casino is allotted one chance at a prize for each threshold amount of contribution and a win/loss decision is made, for each such chance, by a central computer system.

20 Claims, 5 Drawing Sheets

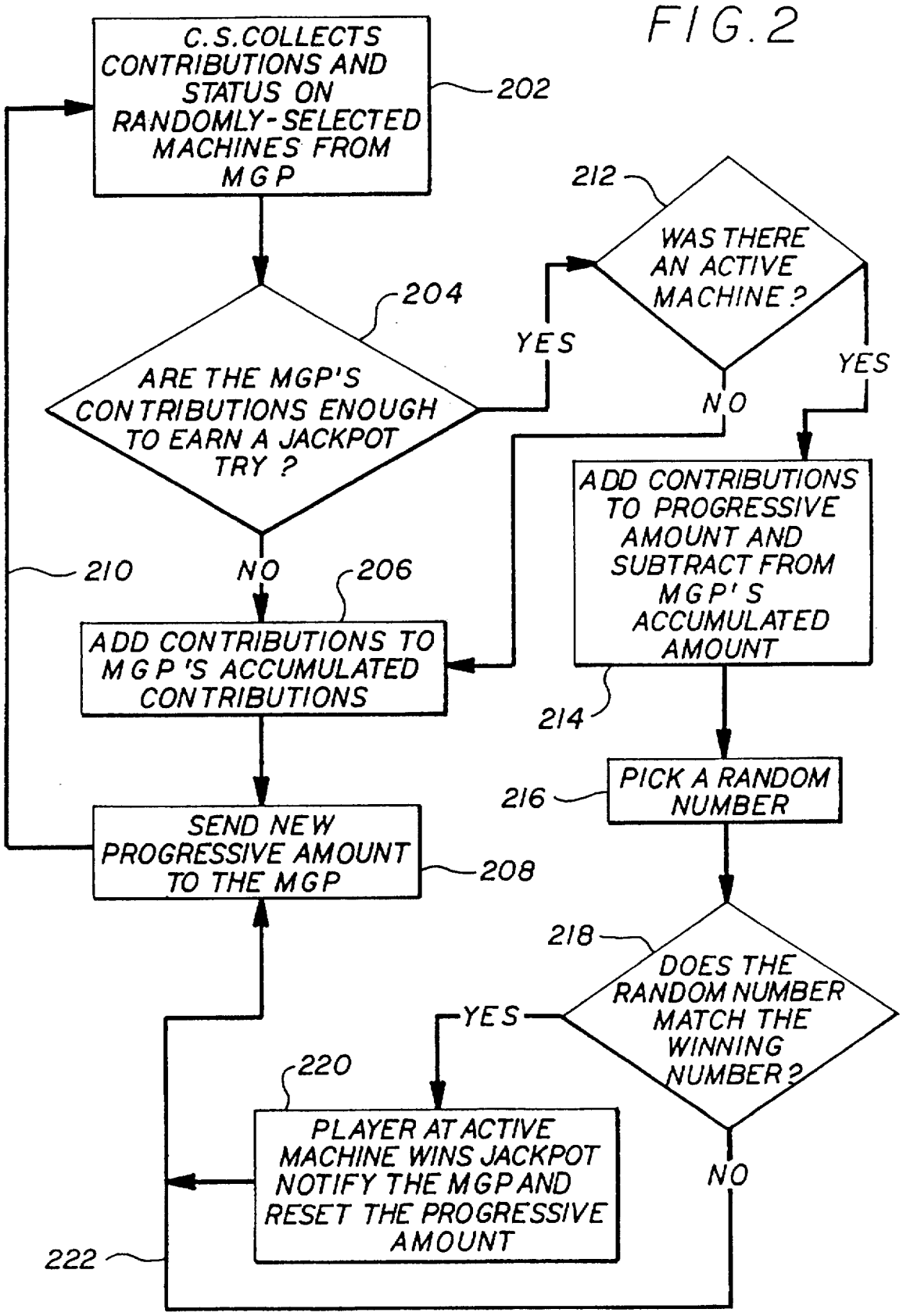
FIG. 2
C.S. COLLECTS CONTRIBUTIONS AND STATUS ON RANDOMLY-SELECTED MACHINES FROM MGP
202
ARE THE MGP'S CONTRIBUTIONS ENOUGH TO EARN A JACKPOT TRY ?
204
YES
NO
WAS THERE AN ACTIVE MACHINE ?
212
YES
NO
ADD CONTRIBUTIONS TO PROGRESSIVE AMOUNT AND SUBTRACT FROM MGP'S ACCUMULATED AMOUNT
214
210
206
ADD CONTRIBUTIONS TO MGP'S ACCUMULATED CONTRIBUTIONS
PICK A RANDOM NUMBER
216
SEND NEW PROGRESSIVE AMOUNT TO THE MGP
208
218
DOES THE RANDOM NUMBER MATCH THE WINNING NUMBER ?
YES
NO
220
PLAYER AT ACTIVE MACHINE WINS JACKPOT NOTIFY THE MGP AND RESET THE PROGRESSIVE AMOUNT
222

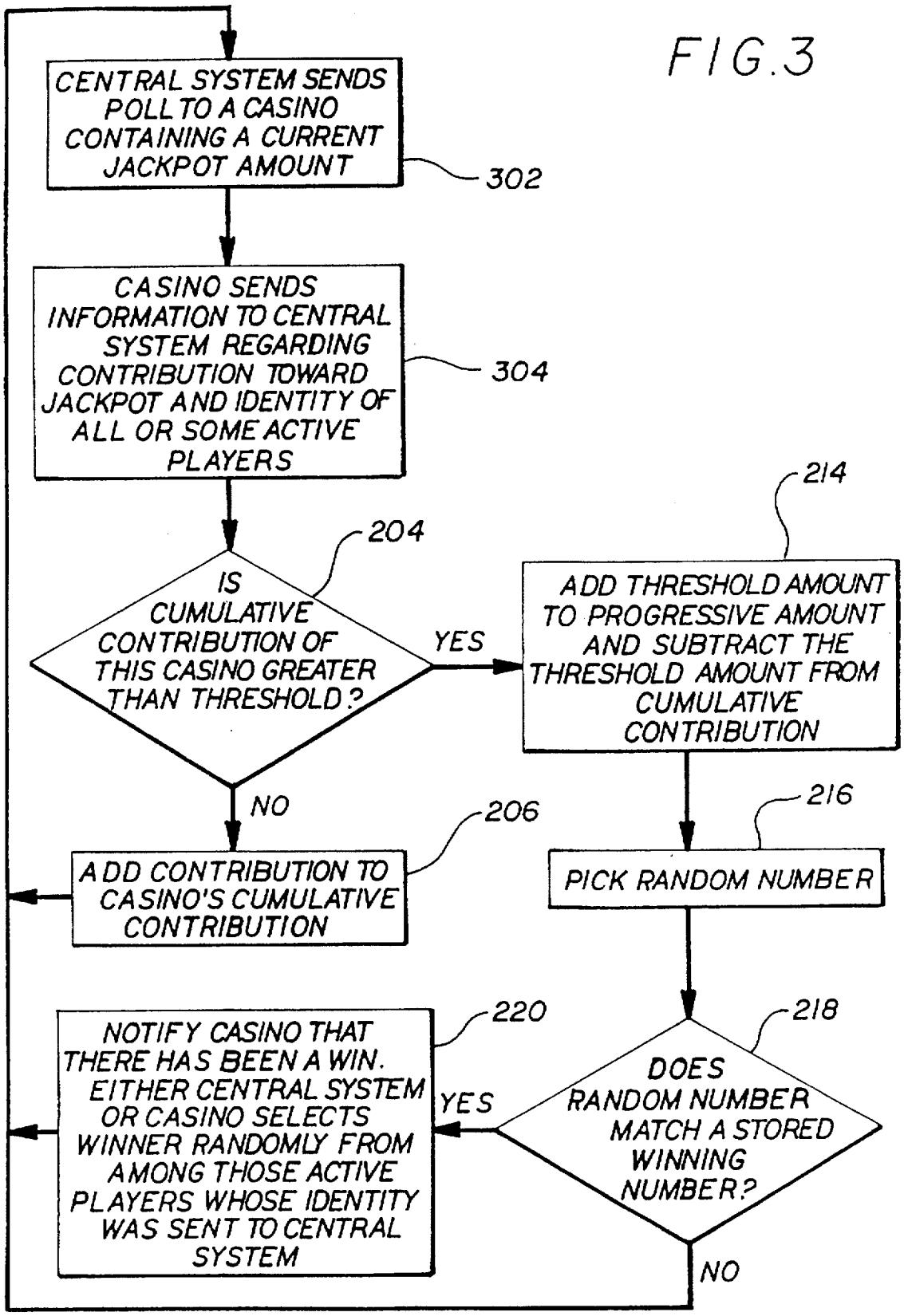
FIG.3
CENTRAL SYSTEM SENDS POLL TO A CASINO CONTAINING A CURRENT JACKPOT AMOUNT
302
CASINO SENDS INFORMATION TO CENTRAL SYSTEM REGARDING CONTRIBUTION TOWARD JACKPOT AND IDENTITY OF ALL OR SOME ACTIVE PLAYERS
304
204
IS CUMULATIVE CONTRIBUTION OF THIS CASINO GREATER THAN THRESHOLD?
YES
NO
214
ADD THRESHOLD AMOUNT TO PROGRESSIVE AMOUNT AND SUBTRACT THE THRESHOLD AMOUNT FROM CUMULATIVE CONTRIBUTION
206
ADD CONTRIBUTION TO CASINO'S CUMULATIVE CONTRIBUTION
216
PICK RANDOM NUMBER
218
DOES RANDOM NUMBER MATCH A STORED WINNING NUMBER?
YES
NO
220
NOTIFY CASINO THAT THERE HAS BEEN A WIN. EITHER CENTRAL SYSTEM OR CASINO SELECTS WINNER RANDOMLY FROM AMONG THOSE ACTIVE PLAYERS WHOSE IDENTITY WAS SENT TO CENTRAL SYSTEM

PROGRESSIVE GAMING SYSTEM AND METHOD FOR WIDE APPLICABILITY

The present invention relates to a progressive gaming system and, in particular, to a system which provides an opportunity to win a jackpot or other prize to any of a number of electronically coupled gaming devices.

BACKGROUND INFORMATION

Gaming systems have included progressive systems in which the machines are linked together so that, in addition to the normal games played on the gaming machines, players can compete for an additional prize. One type of progressive gaming system is described, for example, in U.S. Pat. No. 4,837,728, issued Jun. 6, 1989, and assigned to International Game Technology.

Although progressive gaming systems have proved to be successful, it is believed there is a potential to provide progressive gaming systems which could make the systems available to a larger number of players, preferably while maintaining or enhancing the system's resistance to cheating.

In the past, progressive systems have been typically organized on a gaming device level, e.g., such that when a prize was awarded by the central system, it was directly awarded by the central system to an individual gaming device or terminal. This is believed to, from a practical point of view, place limits on the size of the progressive system, and thus limit its availability to potential players. Furthermore, in many previous progressive systems, the only gaming devices or terminals which could be used to participate in the progressive gaming were those which were specially constructed for coupling to a particular progressive system, such as only gaming devices made by a particular manufacturer, only those devices for playing a particular game, and/or only those devices using a certain monetary denomination or range of denominations (e.g. only dollar slot machines).

In some progressive systems, the event which triggers a potential win of a progressive jackpot is a win at a local gaming device. For example, in some slot machine systems, no progressive jackpot may be awarded until a play at one of the slot machines connected to the progressive system has resulted in a winning combination. In some systems, no prizes are awarded until a threshold condition occurs (such as the progressive jackpot reaching a variable threshold amount). The progressive jackpot will then be awarded to the player at the first connected slot machine to indicate a win. Although such a system is operable, it is believed a system which requires a local win in order to qualify for a progressive jackpot win does not provide the greatest entertainment value and player attraction possible.

Accordingly, it would be advantageous to provide a progressive gaming system which is not limited to awarding prizes to an individual gaming device or terminal, is not limited to a particular manufacturer, style or denomination of gaming terminal, is not limited to awarding the progressive jackpot only to local winners, and/or has potential for enhancing the number of players who can partake in the progressive system play while maintaining or enhancing resistance to cheating.

SUMMARY OF THE INVENTION

The present invention permits a hierarchically-organized progressive gaming system in which the central system need not directly award a prize to a player at an individual gaming device or terminal. In one embodiment, multiple casinos (or other groupings) are coupled to a central system, and the central system provides each casino or group with a predetermined number (e.g. one) of chances at a prize for each buy-in, i.e. each multiple of a predetermined amount of contribution to the prize or jackpot. If a prize is awarded, as a result of such a chance at the prize, the casino or group awards the prize to a player (or players) who is (or recently was) actively playing in that casino or group, and who was randomly selected (possibly with some weighting, e.g., based on the denomination of the game) with the winner preferably being selected at the casino level. Thus, in one embodiment, the invention involves a hierarchy of at least three levels; gaming terminal, casino, and central system, in which there is no need for direct communication between the gaming terminals and the central system. Further, according to the present invention it is possible for a player to win a progressive jackpot even though that player has not had a local win, i.e. has not won a game on the particular gaming device being used.

To avoid the need for using only machines of a certain manufacturer or configured for a certain game, the system is preferably configured to operate in conjunction with any of a number of different types of gaming devices, (and/or networks of other electronic communication systems). In one embodiment, the progressive system can include any casino which uses a player tracking system such as a system in which users may use one or more encoded cards, which enable play, and/or identify the player. Because, particularly, these systems can be coupled to any of a number of types of machines, including machines made by different manufacturers, having different denominations and the like, the progressive gaming system of the present invention can be used in connection with a wide variety of gaming and other devices.

A number of approaches can be used to maintain or enhance resistance to cheating. In one embodiment, the progressive system is used only in connection with machines which have a capability of identifying a player, such as machines having a player tracking system. Preferably a casino identifies a potential winner for a given "chance" at the prize before the central system determines whether the casino (or, more properly, a player at that casino) has won the prize. Typically, in the system, the central computer will not know the identity of all potential winners (and/or will not know the identity of the winning player) at the time the prize is awarded. In another embodiment, for each chance a casino has at a prize, the casino transmits the identity or names of a plurality of randomly or pseudo-randomly selected players (winner nominees) to the central system and, if the central system determines that the casino was a winner, the central system selects, randomly, one of the nominated players as the winner. In another embodiment, rather than identifying players, the casino selects a particular machine or device as a potential winner.

BRIEF DESCRIPTION OF THE DRAWINGS

FIG. 2 is a flowchart depicting a method for selecting a winner, according to an embodiment of the present invention;

FIG. 3 is a flowchart depicting a method for selecting a winner, according to an embodiment of the present invention;

DETAILED DESCRIPTION OF THE PREFERRED EMBODIMENTS

Figure 1:
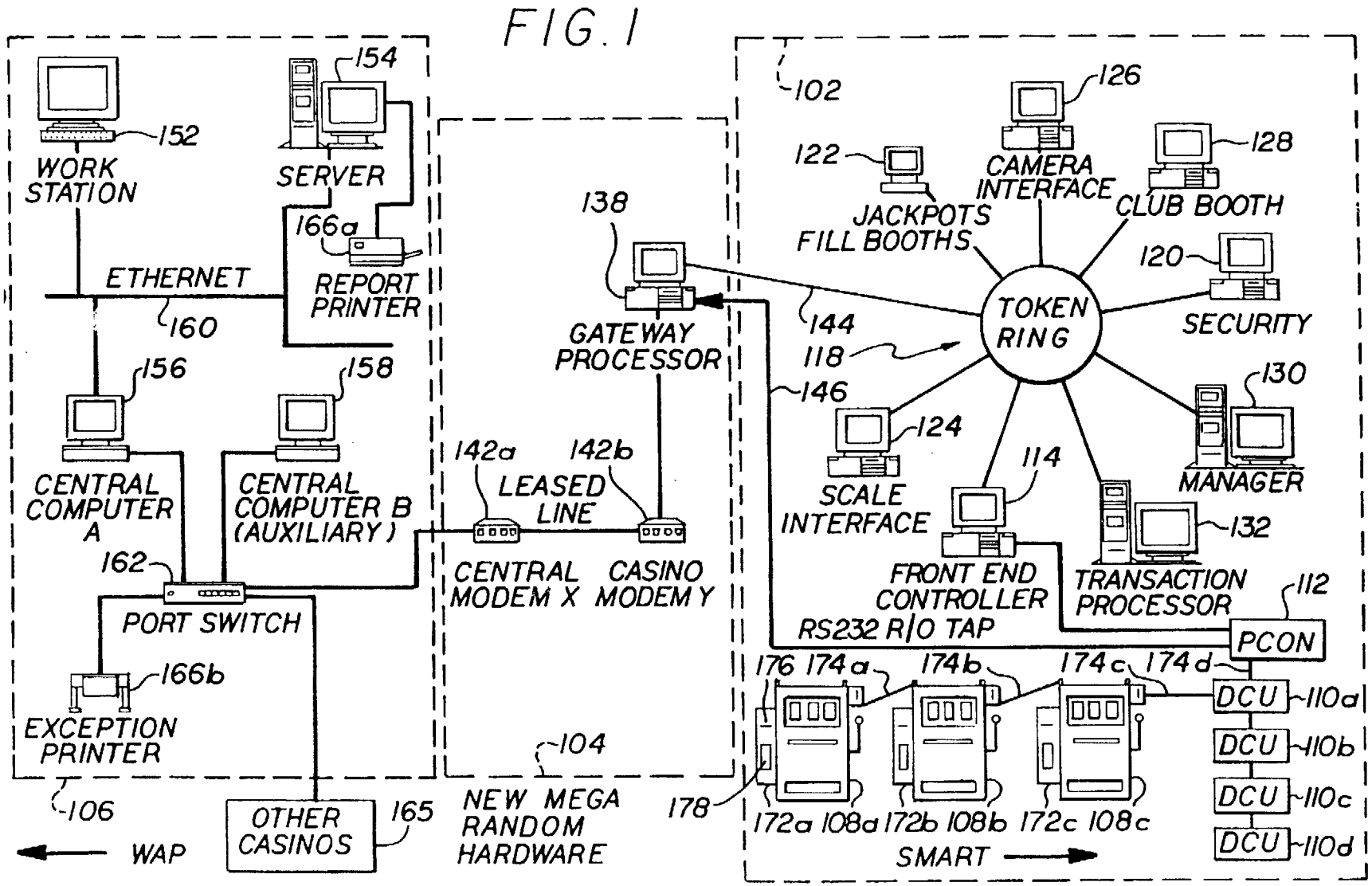
FIG. 1 is a schematic view of a gaming system, according to one embodiment of the present invention.

As depicted in FIG. 1, a gaming system may include a plurality of electronically-coupled components. In the embodiment depicted in FIG. 1, the system can be considered in three portions, a casino gaming and player tracking system 102, a casino progressive system 104, and a central computer system 106. The first portion 102 includes a plurality of gaming devices or terminals 108*a*, 108*b*, 108*c*, which can be any of a plurality of gaming devices or other operable and/or entertainment devices. In the depicted embodiment, the gaming devices 108*a*, 108*b*, 108*c* are slot machines. Other types of gaming devices that can be used include electronic slot machines, electronic poker machines, blackjack machines, 21 machines, lottery terminals, and the like. In the depicted embodiment the gaming devices 108*a*, 108*b*, 108*c* are coupled in a daisy-chain fashion through daisy chain unit 110*a*, to a processor controller 112, for coupling to a computer such as front end controller computer 114. The system may include a plurality of daisy chain units 110*a*–110*d*, each of which is coupled to a plurality of gaming devices 108. Although in the depicted embodiment there are three gaming devices 108*a*, 108*b*, 108*c*, connected to the first unit 110*a*, there may be more or fewer gaming devices coupled to each unit, and there may be more or fewer units. Gaming terminals can be coupled to the controller 114 in topologies other than a daisy chain fashion, such as a star topology, a ring topology, a hub topology and the like, as will be apparent to those of skill in the art.

In one embodiment, the gaming devices 108, which are used in connection with the described progressive gaming system, are those devices which are configured to use a player tracking system, and preferably a player tracking system which permits the casino computer system to identify the players playing at such machines. In general, a player tracker system involves a card reader or other user input-output (I/O) or identification device 172*a*, 172*b*, 172*c*, and cables 174*a* through 174*d*, or other communication links and/or communication electronics for providing information obtained via the I/O devices 172*a*, 172*b*, 172*c* to a computer such as front end controller 114, as well as software in the computer and/or gaming devices for communicating player information and using such information, e.g., as described below. In one embodiment, the player I/O devices 172*a*, 172*b*, 172*c* include a card reader 176, and a display screen 178. In one embodiment, players may purchase or otherwise obtain player tracking cards which are encoded with information such as being magnetically encoded, optically encoded, and/or punch encoded. In one embodiment, the cards may appear similar to a normal credit card with a magnetic strip thereon for encoding information. In one embodiment, when players purchase such cards, a player credit amount, related to the purchase price, is encoded on the card. Alternatively, the card may be encoded with an identity number (ID) or other identification information that is then used to determine the value in a corresponding account held in the central computer system. When the card is inserted in the card slot 176, the gaming device 108*a* will accept the encoded credits or deduct them from the value held in the account as a wager amount, preferably updating the information to deduct wager amounts and reflect a current credit balance, and/or to add winnings. Other identification devices can also be used, such as voice print identification, retinal scan identification, fingerprint or thumbprint scan identification, and the like. Other types of player tracker cards and/or systems can also be used, such as systems which accept an ordinary credit card or debit card, systems which accept cards configured with a microprocessor and/or memory (so-called smart cards), and the like.

In one embodiment the present invention preferably is used in connection with a casino (or other grouping) which is configured with such a player tracking system. This provides numerous benefits. First, such systems provide an electronic coupling of gaming devices 108, to a central network or system 118, and thus the present invention can be implemented by making use of much of the network, communications and/or other infrastructure which is already present 102, and thus can be implemented with little additional hardware. Furthermore, this advantage is consistent with the desire, noted above, to provide a progressive system which is not limited to a particular gaming device manufacturer or configuration. Many player tracking systems have the capability to couple together gaming devices from many manufacturers or having many configurations, and thus by implementing the described progressive system, using an in-place player tracker system, this goal can be readily achieved. Yet another positive aspect of implementing the present invention in connection with a player tracker system, is the ability to maintain or enhance safeguards against cheating, e.g., by identifying potential winners (such as using the player tracker identity capability) preferably prior to determination of a winner by the central computer.

In the embodiment which is depicted and described, it is contemplated that a single chance at a particular prize or jackpot will be provided for each predetermined amount contributed by a casino toward the prize or jackpot. Although much of the following description is in terms of prize chances given to a "casino," the invention is not limited to embodiments in which only casino-wide chances at the prize are provided. There are many ways in which a plurality of gaming devices can be grouped together, so as to provide such grouping of gaming devices with chances at the prize. For example, a chance at a prize may be given (for each minimum contribution of the grouping toward the jackpot) to a subset of all the gaming devices in a casino, such as all the devices in a particular location of the casino, all the devices configured for a particular game, all the devices having a particular denomination or denominations, or the like. Unlike previous systems, such groupings by game or denomination are optional. The casino may be divided into several regions or groups, each group of gaming devices being able to accumulate contributions toward the prize of a size to attain a chance at the prize. The progressive system may be configured such that the groupings are changed from time to time, such as providing different groupings at different times of day, e.g., depending on the level of activity in the casino. It is also possible to have groupings which include gaming devices in two or more casinos, such as all gaming devices in all casinos owned by a particular company, a group of gaming devices in one casino, plus a group of devices in another casino, or the like. Thus, although much of the following description is in terms of a "casino" group, this terminology is provided only for convenience of discussion, and with the understanding that other groupings of gaming devices can also be used.

As one example, it is assumed that a portion (e.g. 0.15%) of the wagers placed on the gaming devices 108*a*, 108*b*, 108c are to be contributed toward the jackpot, and that a casino will receive one chance at the jackpot for every minimum contribution, e.g. for each $4,000 contributed to the jackpot. Assume further, that there are five casinos in the system, each of which does sufficient volume to contribute $20,000 per day towards the jackpot. Thus, in this example, the total jackpot will accumulate at an average rate of about $100,000 per day. In this situation, each casino will receive approximately 5 chances at the jackpot each day. That is, considering all five connected casinos there will be a total of 25 chances at the jackpot per day. If it is assumed that the odds of winning a jackpot, for any chance, are set at one in 2,500, there will, on the average, be a prize awarded once every 10 days, and the average size of that prize will be $1,000,000. Other examples will occur to those of skill in the art once the present disclosure is understood.

It is contemplated that when the central system has determined that the prize has been won, the casino whose "chance" resulted in the win, will award the entire prize to one player (selected, e.g. as described below). However, it is also possible to provide a system in which, once there has been an award of a prize, the casino may divide the winnings among two or more randomly selected players, such as by providing a first prize, second prize, third prize, etc.

In the embodiment of FIG. 1, the gaming devices 108a, 108b, 108c in a casino (or other grouping) are coupled to a computer network, such as a token ring network 118, providing information to a plurality of computers such as PC-type computers, for various purposes, such as security 120, jackpot/fill booth operation 122, scale interface 124, camera interface 126, club booth 128, management 130, and transaction processing 132. In general, the hardware depicted in the casino 102 can be that known in the past for use in many types of player tracking systems.

The hardware of the progressive system 104, and particularly the manner in which it is connected with the casino system 102, and the central computer system 106, and the manner in which it operates or is controlled, e.g., by software, is believed to be different from previous systems. In one embodiment, the progressive system includes an electronic processor such as a computer 138, and a data communications system such as modems 142a, 142b, e.g., for providing communication with the central computer system 106. The processor 138 receives information from the casino system, e.g., over a token ring connection 144, and/or a communications or data tap, such as an RS 232 connection 146. The information received from the casino system 102 may include information regarding which gaming devices 108 are being played, the identity of players at various gaming devices, the amount wagered at the various coupled gaming devices in the casino, and the like. The processor 138 also provides information to the casino system 102, including information regarding the current value of the jackpot, received from the central system 106, via communication devices 142a, 142b, the existence of any winners, and the like. The processor 138 communicates a number of types of information to the central system 106, including accumulated amounts of contributions to the jackpot, e.g., in amounts to permit the casino system 102 to have a chance at the prize.

The central system 106 can be configured in an number of different manners. In the depicted configuration, the central system includes several computers, such as the work station computer 152, a network server 154, a central computer 156, and an auxiliary central computer 158, coupled over a computer network system such as an Ethernet system 160. A port switch device 162 permits the central computer 106 to be coupled not only to the first casino system 102, described above, but also to a plurality of other casinos 165, each of which will be coupled via a processor similar to the processor 138 depicted in FIG. 1. The central system may include various printers 166a, 166b, or other peripheral devices. In one embodiment, the central computer system may have hardware similar to that used for other gaming systems central computers, such as other progressive system central computers. However, the hardware will be controlled or operated, e.g., using software, in a fashion which is believed to be different from that of previous devices.

In one embodiment, all players who have active player tracking cards inserted in gaming devices 108 are eligible for progressive jackpots. Thus, in this embodiment, a player may win a progressive jackpot even though that player has had no win (or no recent win) on the particular gaming device(s) being played. An amount, either a flat amount for each actively played machine or a percentage of the coin-in amount, is earmarked for contribution to the progressive jackpot. A process, such as the gateway processor 138, aggregates these contributions and maintains a current data base of game machines 108, and player identity (or, more precisely, player-tracker card identity).

In this context, an active player may be defined in any of a number of ways. For example, a particular gaming machine may be considered to have an active player if (1) there is a card inserted in the player tracker system at the time of the polling cycle (described below), or within a certain period prior to the polling cycle, such as a predetermined number of seconds prior to the polling cycle, or any time since the previous polling cycle at that casino or, (2) if the gaming device or terminal is currently being played or has been played within a certain period prior to the polling cycle, regardless of whether there is a card in the card slot, (although, in one embodiment, a player is eligible only if the player can be identified, e.g. by a player identification system). Preferably, the system also ensures that a player is actually playing a game and not merely inserting a card and sitting at the machine without wagering. Therefore, certain other timing parameters for before and after a game is played may be included.

In one embodiment, the gateway processor and/or casino system 102, is configured to identify abandoned player tracker cards, i.e., cards which are inserted in machines, but which have not been used for a predetermined period. Preferably, the processor 138 does not allow the players identified at such machines to have a chance at the jackpot until play become active once again on that card. As depicted in FIG. 2, in one embodiment the central computer system 106 periodically or frequently polls the processors 138 for each of the various connected casinos 102, 164, and collects the contribution from the various casinos. In one embodiment, the central system also randomly selects a number of the gaming devices 108 at each casino, and requests information regarding the status (e.g. valid player ID card inserted or not) at those selected machines. In this embodiment, such information is collected in order to detect and/or discourage cheating. In one embodiment, the poll message also conveys to the gateway processor 138 information about the current value of the jackpot. This information can be conveyed back to the casino 102, e.g., for display at the gaming devices 108 if desired. Jackpot amounts can be displayed at the gaming devices in a number of fashions, e.g., via large overhead displays (not shown), as is common with progressive gaming devices, on a video display screen, e.g., on a portion of the screen 177 normally provided for electronic slot machines or other electronic gaming devices, and/or in a smaller display 178 provided as part of the player tracker system or module.

When the central system 106 has polled a processor 138 and retrieved the most recent contribution toward the jackpot, the central system determines whether the accumulated contributions from that casino 102 in the period since that casino's last chance at the jackpot, have exceeded a predetermined threshold amount 204, which has been set as the amount needed to earn a try or chance at the jackpot. If the threshold amount has not been reached 206, the contributed amount is simply accumulated in the account for that casino, the amount of the jackpot is updated 208, and the procedure repeats 210.

If the casino has reached the threshold amount, the central computer 106 then determines whether the status information sent by the processor 138 indicates that at least one of the machines 108 in the casino was active 202. If there was not an active machine among the first random selection of machines in the casino, the contributions are accumulated and the system repeats so as to collect data on another randomly selected sample of the machines in the casino 202. In one embodiment, this cycle 204, 212, 206, 208, 210, 202, will repeat until either a poll response 202 returns with an active player ID or the procedure times out. In this way the central system 106 ensures that a casino 102 will receive one and only chance or attempt at the jackpot for every threshold amount of contribution towards the jackpot.

Once the threshold amount has been reached and an active gaming device 108 has been identified, the contributions from the casino are added to the progressive jackpot, and the threshold amount is subtracted from the casino's accumulated amount 214. The central processor 106 then determines whether, as a result of the attempt or chance at the jackpot, the casino (or more properly, one or more players at the casino) is a winner. In the depicted embodiment, this is done by the central computer system 106, generating a random number in a predetermined range, with the range being selected according to the predetermined odds of winning. For example, if the odds of winning are one in 2,500, the central computer will select a number randomly 206 in the range of 1 through 2,500. The computer will then compare this randomly selected number with a previously stored and randomly generated winning number 218. If there is a match, then the player at the active machine identified in step 212 is the winner of the jackpot 220. This information is conveyed to the processor 138, and the progressive amount of the jackpot is reset and a new winning number is randomly generated. If there is no match, then the casino's chance at the jackpot was unsuccessful, and the procedure repeats 222. The same procedure is followed for each casino connected to the central system 106, with the casinos being polled successively.

A number of procedures can be used in connection with the present invention. Preferably, the procedures are configured to maintain or enhance the ability to detect, deter and/or prevent cheating. Preferably, the procedures require that potential winners are identified and logged in an auditable manner at both the casino level and the central system, preferably prior to selection of an actual winner. In one embodiment, the central system polls the various casinos to retrieve and transmit various information. As will be apparent to those of skill in the art, the present invention can be used in connection with communication systems other than polling systems, such as interrupt or peer-to-peer systems. In one contemplated polling system, it may require several polls and responses before the desired communication is finished and the central system moves on to poll another casino. Such a group of polls of a casino is referred to herein as a polling cycle. In a relatively small system, it may be possible to transmit the identity of every active player to the central system on every poll cycle. However, it is believed such communication would be impractical in a relatively large system, since it would require communication of a very large volume of information at a high frequency. Accordingly, in another embodiment, the casino sends the identity of only a subset of all active players on each poll cycle. The central system may request such information periodically from each casino in order or may randomly query the casinos for player identification.

In the embodiment depicted in FIG. 3, in response to a poll sent from the central system 302, the casino transmits to the central system, in addition to the amount being contributed to the jackpot, the identity of all active players in the casino or the identity of a subset of all active players, preferably randomly selected 304. The process of determining a threshold contribution and selecting a winner 204, 206, 214, 216, 218, is similar to that depicted in FIG. 2. If there has been a winner, the central system 106 then notifies the casino 102, which may then select the actual winner randomly from among the subset or pools of nominated winners sent to the central system or, alternatively, the central system may make this selection from among the pool of potential winners 220. In general it is preferred for the casino to make the selection in those embodiments in which selection is random but weighted, e.g. giving preference to players who are playing on higher-denomination machines, or weighting the selection proportional to the relative amount a given player or machine has contributed toward the threshold.

Figure 4:
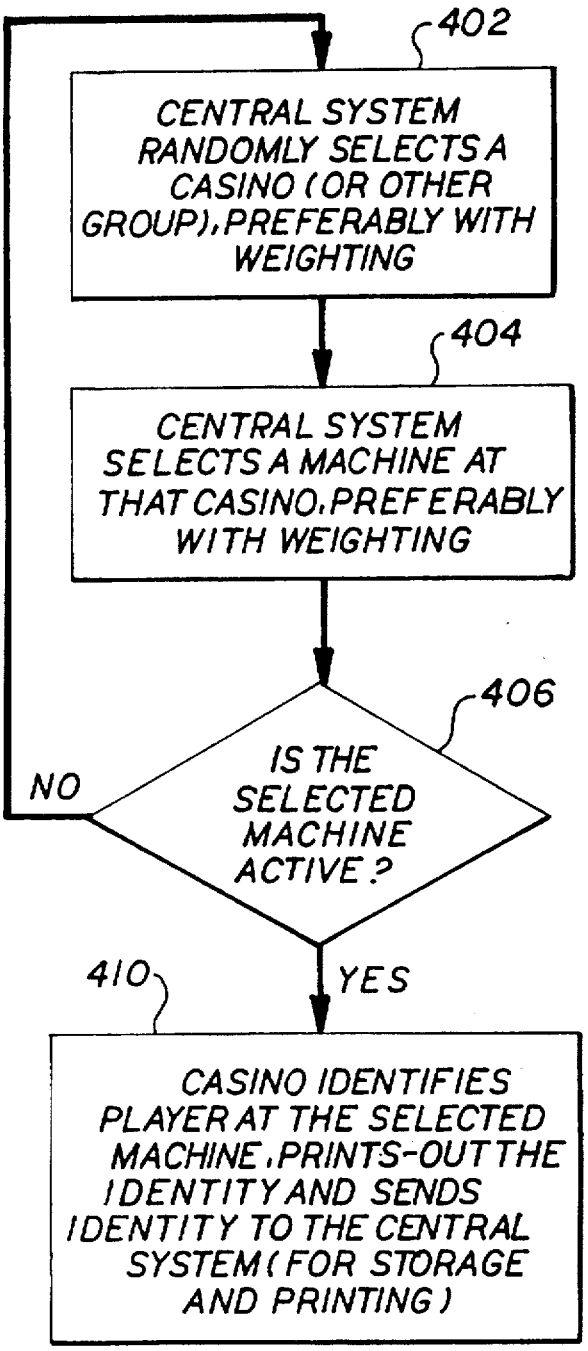
FIG. 4 is a flowchart depicting a method for selecting a winner, according to an embodiment of the present invention.

In one alternative, it is possible for each casino to transmit to the central system the identity of a single active player who will be the winner if the casino's chance or try at the prize is successful. In the embodiment depicted in FIG. 4, the central system randomly selects one of the casinos (or other group or location 402). This selection could, if desired, be a random but weighted selection (e.g., with a weighted scaling factor based on the number of machines per location, based on the contributions per location, or the like). The weighted scaling factor could be based upon an average contribution level per casino or actual contribution levels. Since, in one embodiment, the aggregate contribution per location is sent to the central system on each poll cycle, the scaling factor used in randomly selecting a location could be dynamically calculated based on the actual contributions for each location. After a location or casino is selected, the central system selects a machine at that location 404. This selection may also be a weighted random selection, e.g., using a weighted scaling factor based upon machine denomination. This selection would then be sent to the casino system, which would determine whether there was an active player at that selected machine 406. If there is no active player, the process will return 405 to permit the central system to select another machine. If there is an active player, the casino will identify the player at that machine (e.g., using a player tracking system), and may store, print out or otherwise log such identification, as well as sending the identity of the player to the central system (e.g., for storage and/or printing). Ultimately, a potential winner will be identified and logged by this process. Using this system, when a random number selection and comparison results in a determination of a win (e.g., using the selection and comparison method 216, 218 depicted in FIG. 2), the last recorded potential winner becomes the actual winner.

Figure 5:
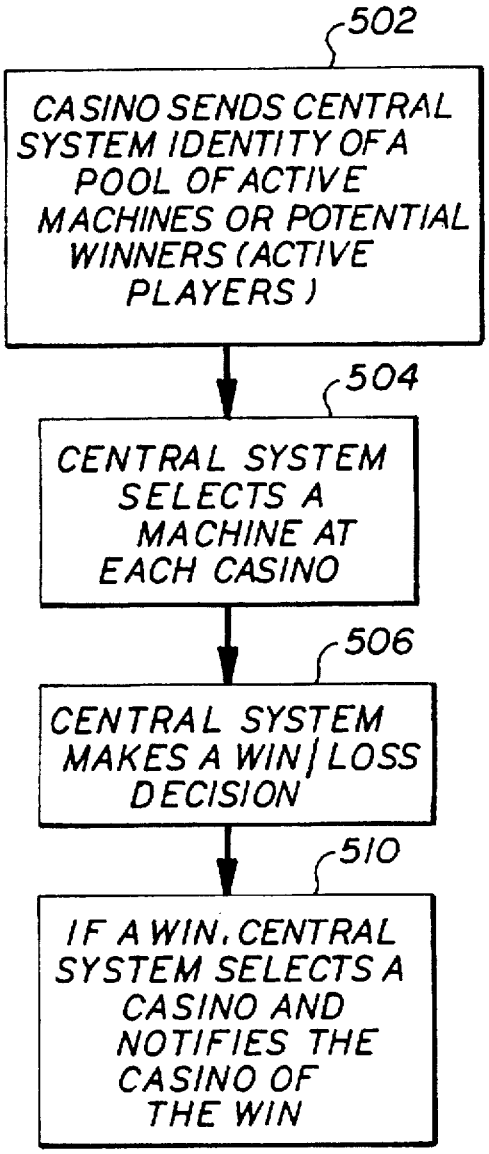
FIG. 5 is a flowchart depicting a method for selecting a winner, according to an embodiment of the present invention.

In yet another alternative, in response to a poll, the casino sends to the central system a pool of (randomly selected)

actively-playing potential winners 502 (FIG. 5). This pool is randomly selected at the casino level, if desired, with a weighting factor, such as that described above In this way, a pool of potential winners is provided on each poll cycle. The central system would randomly select a potential winning machine from each location or casino 504, and preferably this information will be appropriately stored, printed or otherwise logged in an accountable manner, e.g., as described above in connection with FIG. 4. The central system, after making a win/loss determination 506 (e.g., using a win/loss determination similar to that depicted in FIG. 2, 216, 218) will, if there is a win 508, select the winning location and notify the casino 510. Since a pool of potential winners is available, all of them active players, the retry loop 405 (depicted in FIG. 4) is avoided, thus potentially reducing the amount of communication necessary. If no active players are identified by the casino in response to a poll 502, the central system ignores that polling cycle and repeats the process at a later time. In the embodiment of FIG. 5, security is maintained or enhanced since a single potential winner is not identified until after the award is determined 508, and yet a complete auditable trail of potential winners is available 502. The central system has a log of selections made at each casino on every poll cycle, not just from randomly selected locations. By providing this communication at every location on every poll cycle, overall integrity of the audit trail is relatively high.

In connection with the embodiment of FIG. 5, there may be some concern that the potential for cheating is shifted from the casino level to the central system. However, since the potential winner information is sent to the central system for audit purposes only (i.e., it is not necessary in order for the central system to make the win/loss decision 508), one approach is to send the information from the casino 502 in encrypted form. It would then be possible to delay sending the encryption key from the casino to the central system until after the next polling cycle, i.e., until after the next pool of potential winners is sent to the central system. By delaying the transmission of the key until the next polling cycle, integrity of the system is enhanced. In the case of an actual winner, the central system would not be able to decrypt the winner identity information until after the selection was made.

Figure 6:
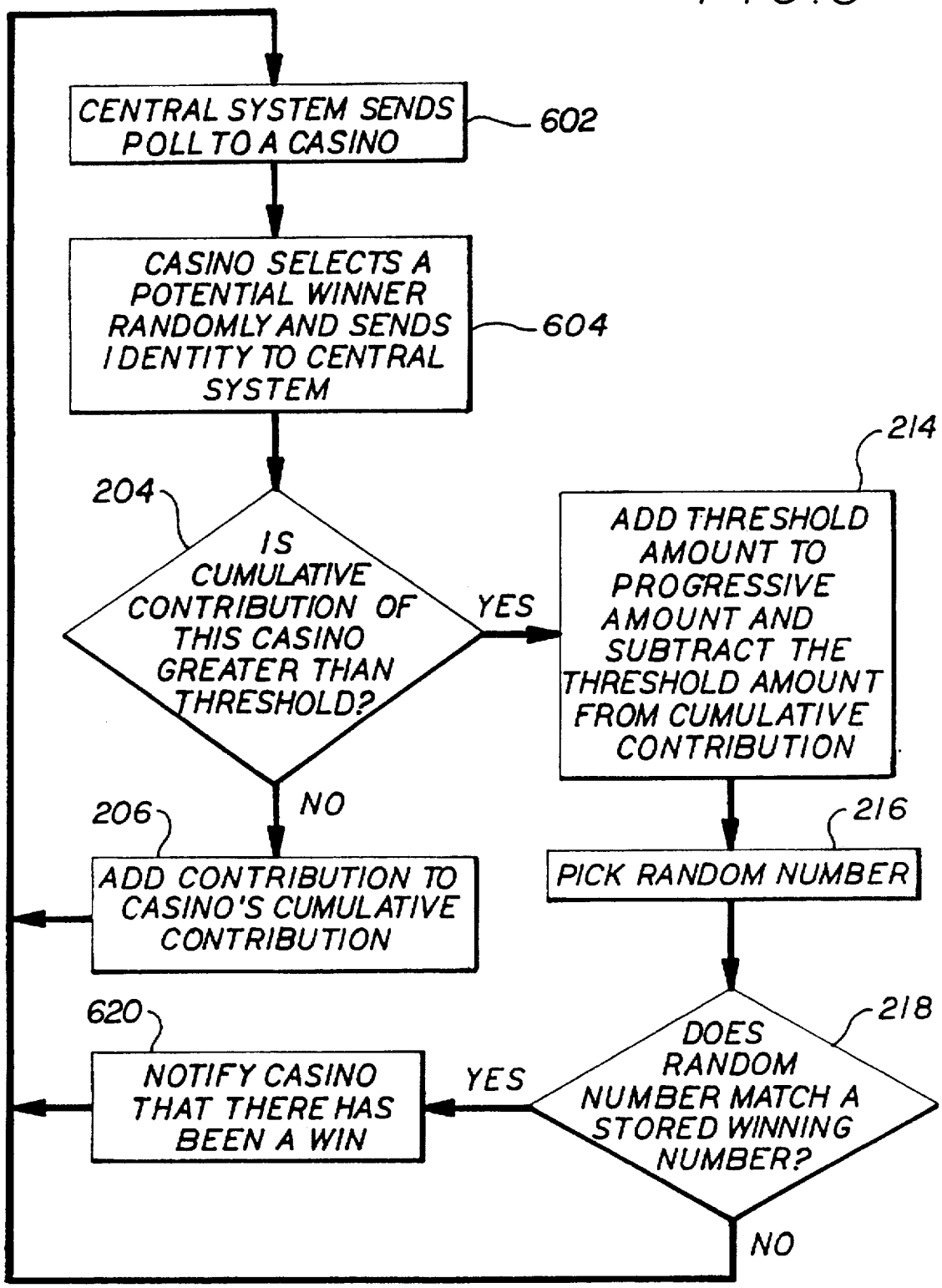
FIG. 6 is a flowchart depicting a method for selecting a winner, according to an embodiment of the present invention.

According to another embodiment, depicted in FIG. 6, in response to a poll 602, the casino randomly selects a single potential winner, identifies that potential winner (who will be an active player) and sends the identity of this potential winner to the central system 604. The remainder of the procedure 204, 206, 212, 214, 216, 218, is similar to that depicted in FIG. 2, except that, following a win, it is necessary only for the central system 620 to notify the casino that the nominated winner has won. If desired, it is possible to delay the selection, identification and/or transmission of the identity of the potential winner until after a determination that this casino has reached the threshold contribution 632, and/or after there has been a determination that there has been a winner 634. In the latter case, in order to comply with the objective of identifying potential winners before the winner selection, it is only the transmission to the central system that is delayed, rather than the step of identifying the potential winner.

When there has been a winner, the casino may respond in any of a number of fashions. For example, the winning machine may sound a bell or other audible signal, display a light, and the like. In the event a player has removed his or her card before the win alarm is sounded, casino personnel will have the player's identity (via the player tracking system) and can notify the winner in person.

In light of the above description, a number of advantages of the present invention can be seen. The present invention provides a progressive gaming system which is not limited to awarding a prize or jackpot by a central system directly to an individual gaming device or terminal. The present invention is believed to provide a potential for making progressive gaming systems available to a larger number of players and is not limited to participation, in a given system, only to those devices which are specially constructed for coupling to a particular progressive system, only those devices made by a particular manufacturer, only those devices for playing a particular game or only those devices using a certain monetary denomination. It is believed that, in addition to making the system widely available to a number of different players, the system also maintains or enhances resistance to cheating. The present system is believed to make it possible for a large number of terminals (such as on the order of ten thousand terminals) to participate in a single progressive prize while still providing effective and efficient communication of information among the computer of the system.

A number of variations and modifications of the present invention can be used. Although the progressive gaming system has been described in connection with gaming terminals such as electronic slot machines and the like, the embodiments of the present invention can be used in connection with a number of user input devices which are coupled together or coupled to a central system including automatic teller machines (ATMs), vending machines, telephone systems, interactive television systems, networked computers such as local area networks, wide area networks, client server or peer-to-peer networks, dial-up computer services such as dial-up internet services, dial-up database services and the like or permanent-node internet communications or database service communications. It is possible to use some aspects of the invention without using other aspects. For example, it is possible to use a three-level terminal-casino-central system for a progressive gaming system without transmitting the identity of a winner or potential winner to central system.

Although the invention has been described by way of a preferred embodiment and certain variations and modifications, other variations and modifications can also be used, the invention being defined the following claims.

What is claimed is:

1. A method for use in a progressive gaming system having a central system for making a determination of whether a progressive prize has been won, and gaming terminals for use by players, wherein said gaming terminals are used in awarding local prizes to said players, comprising:

coupling a first computer to a plurality of gaming terminals wherein said first computer is configured for communication with said central system;

communicating, from said central system to said first computer, a determination that said progressive prize is to be awarded;

selecting, in said first computer, one of said gaming terminals, wherein one of said players who has played on said gaming terminal is to be awarded at least a portion of said progressive prize, regardless of whether said player has won a local prize on said gaming terminal.

2. A method, as claimed in claim 1, further comprising;

communicating from said first computer to said central system, the magnitude of a contribution related to the total of the amounts wagered on said plurality of gaming terminals; and making said determination in said central system only after an accumulated amount of said contributions has exceeded a threshold amount.

3. A method, as claimed in claim 2, further comprising:

identifying, in said first computer, at least one potential winner before said step of making said determination.

4. A progressive gaming system having gaming terminals for use by players and said progressive gaming system also having a central system for making determinations of whether a progressive prize has been won comprising:

a first processor coupled to a first plurality of gaming terminals, said first processor configured to communicate first information to said central system, said first information including at least a magnitude of a contribution from said first plurality of gaming terminals towards said progressive prize;

a second processor coupled to a second plurality of gaming terminals, said second processor configured to communicate second information to said central system, said second information including at least a magnitude of a contribution from said second plurality of gaming terminals towards said progressive prize;

wherein said central system is configured to make at least one said determination in response to a cumulative amount of said contribution by one of said first plurality of gaming terminals and said second plurality of gaming terminals exceeding a predetermined threshold.

5. A progressive gaming system as claimed in claim 4, further comprising a player tracker coupled to at least said first processor and said first plurality of gaming terminals to identify at least one player at one of said plurality of gaming terminals.

6. A progressive gaming system as claimed in claim 5, wherein said first processor is configured to communicate with said central system by a communication link which includes at least part of said player tracker.

7. A progressive gaming system as claimed in claim 5, wherein said first information includes an indication of the identity of at least said first player.

8. A progressive gaming system as claimed in claim 5, wherein said player tracker identifies said at least one player in advance of said determination by said central system.

9. A progressive gaming system as claimed in claim 4, wherein said central system makes said determination by generating a substantially random number for comparison to a stored number.

10. Apparatus for a progressive gaming system comprising:

first and second pluralities of gaming terminals in first and second locations, each gaming terminal configured for receiving wagers from players, and having a card reader for reading a card which identifies a player at said gaming terminal;

first and second computer network systems coupled to said first and second pluralities of gaming terminals respectively;

each network system receiving from said coupled plurality of gaming terminals information related to the amount of wagers placed on said gaming terminals by said players and information indicating the identity of the players in accordance with the identities indicated by said card readers;

first and second computers coupled to said first and second networks and having a communication link to a central computer system;

said first and second computers configured to communicate to said central system, the magnitude of a contribution from said first and second pluralities of gaming terminals respectively towards a progressive prize;

said central computer system configured to periodically poll said first and second computers, wherein said first and second computers, in response to said polling, transmit to said central computer system an indication of said contribution;

said central computer system accumulating said contributions in first and second accounts for said first and second pluralities of gaming devices until any said account reaches a threshold amount whereupon said central system;

subtracts the threshold amount from said account;

adds said threshold amount to said progressive prize;

generates a random number between 1 and a predetermined odds number and;

compares said random number to a stored winning number;

wherein when said generated random number matches said stored winning number, said central system communicates a win decision to at least one of said first and second computers whose account reaching said threshold was responsible for generation of said random number and;

wherein said one computer, in response to receipt of said win decision, generates a signal to notify at least one of said players that said player has won said progressive prize;

wherein there is no direct communication between said gaming terminals and said central computer system.

11. A method for use in a progressive gaming system having gaming terminals for use by players and a central system for making a determination of whether a progressive prize has been won comprising:

coupling a first computer to a first plurality of gaming terminals wherein said first computer is configured for communication with said central system;

communicating from said gaming terminals to said first computer information indicating the amount of wagers placed on said gaming terminals;

communicating from said first computer to said central system the magnitude of a contribution related to the total of the amounts wagered on said plurality of gaming terminals;

determining, in said central system, when an accumulated amount of said contributions exceeds a threshold amount and, in response, making said determination;

communicating, from said central system to said first computer, when said determination is a determination of a win.

12. A method as claimed in claim 11, further comprising communicating, from said first computer to at least one of said players, information indicating that said player has won said progressive prize.

13. A method as claimed in claim 11, further comprising identifying at least one of said players by said computer.

14. A method as claimed in claim 11, wherein said step of identifying is performed before making said determination in said central system.

15. A method as claimed in claim 11, further comprising identifying, in said first computer, at least one potential winner.

16. A method as claimed in claim 15, wherein said step of identifying at least one potential winner is performed before making said determination in said central system.

17. A method as claimed in claim 15, further comprising communicating first information indicating the identity of said potential winner before said determining in said central system.

18. A method as claimed in claim 17, further comprising encrypting said first information prior to said communicating of said first information.

19. A method as claimed in claim 18, further comprising communicating a decryption key for said encrypted first information to said central system after said step of determining in said central system.

20. Progressive gaming apparatus comprising:

a plurality of gaming terminals for use by players;

a computer coupled to said plurality of gaming terminals for communication therewith, said computer coupled to a central computer system for communication with said central computer system;

said computer having means for receiving information indicating the amount of wagers received in said gaming terminals and for communicating to said central system the magnitude of a contribution towards said progressive prize;

said central system having means for receiving said information indicating contributions and for making a win/loss determination when said contribution reaches a threshold amount, said central system further having means for communicating to said computer when said win/loss decision results in a win; and means for notifying a player of a win of the progressive prize.

* * * * *